US007314083B1

(12) United States Patent
Martini

(10) Patent No.: US 7,314,083 B1
(45) Date of Patent: Jan. 1, 2008

(54) SLOW ROTATION FLUID JETTING TOOL FOR CLEANING A WELL BORE

(76) Inventor: Leo A. Martini, P.O. Box 795, Edgewood, TX (US) 75117

( * ) Notice: Subject to any disclaimer, the term of this patent is extended or adjusted under 35 U.S.C. 154(b) by 299 days.

(21) Appl. No.: 11/052,726

(22) Filed: Feb. 7, 2005

(51) Int. Cl.
*E21B 37/00* (2006.01)

(52) U.S. Cl. ..... 166/311; 166/170; 166/177.7; 166/178; 166/223

(58) Field of Classification Search ..... 166/311, 166/70, 170, 177.7, 178, 222, 223, 312; 175/296
See application file for complete search history.

(56) References Cited

U.S. PATENT DOCUMENTS 4,349,073 A * 9/1982 Zublin ..... 166/312
4,799,554 A * 1/1989 Clapp et al. ..... 166/223
4,890,682 A * 1/1990 Worrall et al. ..... 175/296

* cited by examiner

*Primary Examiner*—Lanna Mai
*Assistant Examiner*—Matthew J. Smith
(74) *Attorney, Agent, or Firm*—John F Bryan

(57) ABSTRACT

A rotary jetting tool for connection to a hollow, fluid conducting workover string has a main tool body with a hollow central passageway and a rotatable jet carrier mounted on a depending central shaft. A rotor, with fluid conducting passageways is mounted on the central shaft for rotation and limited axial movement and has fluid flow reaction outlets to urge rotation and axial movement. A striking lug on the rotor cooperates with a reaction lug on the jet carrier to provide incremental rotation and a jet head, with jet orifices directed to impact mineral deposits in the well bore is connected to the jet carrier and houses the rotor, so as to receive and discharge workover string fluid flow through the jet orifices as the jet head rotates.

16 Claims, 1 Drawing Sheet

SLOW ROTATION FLUID JETTING TOOL FOR CLEANING A WELL BORE

TECHNICAL FIELD

The present invention relates to the field of oil field well tube bore cleaning apparatus and more particularly, to such devices as use rotary fluid jets for cutting and removing mineral and other internal deposits from an oil well tube.

BACKGROUND

In order to maintain production of an existing well it sometimes becomes desirable to clean the tubing bore of mineral and other deposits. These deposits not only tend to reduce product flow through the tube, but also obstruct the passage of other workover tools, which may be employed to enhance production. High-speed rotary jetting tools are in common use on coiled tubing workover rigs for this purpose. In general, these so called "whirl jets" have radially directed jets in combination with tangentially directed jets that make the tool spin at essentially uncontrolled speeds ranging from 500 to 5,000 rpm. Tool rotation is deemed to be necessary in order to clean the entire inside surface of the tube. The down side of this whirling action is that jet impact is not focused on any point but rather, it loses its integrity and is sprayed along a path around the tubing bore. The higher the speed of rotation, the longer the path and the less effective the cleaning action. As a result, whirl jets are generally considered to be bore washing devices rather than bore cleaning devices.

The most effective jetting tool for breaking-up mineral deposits would be non-rotating, but since it is necessary to clean the entire bore of the tube, some rotation is obviously desirable. Whirl jets may have a combination of radial and tangential jets but none in the prior art have achieved a controlled, slow speed of considerably less than 100 rpm, as is necessary for effective bore cleaning.

A first object of the present invention is therefore, to provide a slowly rotating jetting tool for removal of hard mineral deposits in a well bore. A second object is that the tool rotational speed be less than 60 rpm, so as not to unduly diminish jet impingement velocity and impact for deposit removal purposes and a third object is that the rotational speed is stable and not affected by operating conditions. A fourth object of the present inventions is that the jetting tool be centralized in the well tube for stability and more uniform cleaning action. Yet other objects of the present inventions are that the jetting tool be inexpensive to manufacture and easy to maintain.

SUMMARY OF THE INVENTION

The present invention addresses the aforesaid objectives in a jet bore cleaning apparatus wherein the velocity and impact of the cleaning jets is delivered undiminished to the tubing or casing bore deposits. In the present inventions, the sole function of all of the jets is deposit removal and the jetting head rotates slowly so that the jets bear directly on the mineral deposits, rather than being sprayed ineffectively across a large area. This is accomplished by providing a wholly separate mechanism for implementing slow, positively controlled rotation of a jet head at speeds well under sixty revolutions per minute.

The rotary jetting tool of the present inventions has a main tool body with a hollow central passageway. A rotatable jet head carrier is mounted on a fluid conducting central shaft.

A rotor, with fluid conducting passageways is co-axially mounted on the central shaft for rotation and limited axial movement. Fluid flow reaction outlets in the rotor urge rotation and axial movement. The rotor has a striking lug and the jet head carrier has a cooperating reaction lug. When the rotor is at one end of its axial range, its striking lug rotates to hit against the reaction lug of the jet head carrier so as to impart an increment of rotation thereto. The rotor lug is then deflected so that the rotor moves to the other end of its axial range where the lugs clear each other, freeing the rotor for further rotation. A jet head, with jet orifices, is connected to and rotates with the jet head carrier. The jet head houses the rotor, so as to contain the workover string fluid flow and discharge it into the bore, through the jet orifices. Thus, rotation of the jet head is accomplished incrementally, with static dwell periods between movements. The rate of rotation becomes a function of the relative mass of the jet carrier and jet head assembly to that of the rotor, the ramp angle of the lugs, and the reaction porting of the rotor. Rotating speeds as low as 6 r.p.m. have been achieved in stable operation with a preferred embodiment of the present invention and selecting values for these elements can provide positive jet head rotation at virtually any reasonable rate.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
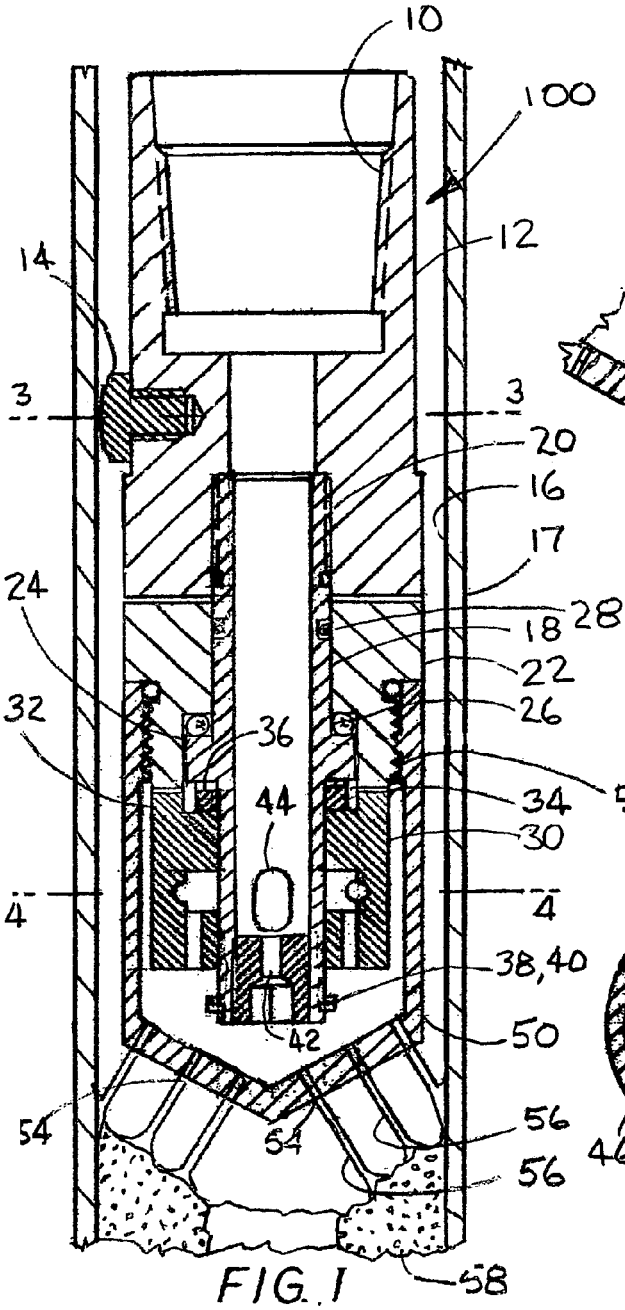
FIG. 1 is a cross-section view of a preferred embodiment of the rotating jet bore cleaner of the present inventions.

The present inventions are described in the following by referring to the drawings of examples of how the inventions can be made and used. In these drawings, reference characters are used throughout the views to indicate like or corresponding parts. The embodiments shown and described herein are exemplary. Many details are well known in the art, and as such are neither shown nor described.

FIG. 1 is a cross-section of a preferred embodiment of the well bore cleaning jet tool 100 of the present inventions. Here is shown threaded connection 10 in tool top sub or main body 12, for attachment to the downhole end of a well workover rig hollow coiled tubing string. Fluid is supplied to tool 100 at high pressure through the unshown tubing string. Also to be noted are the three pads 14 in main body 12, which serve to keep tool 100 at a central location in the bore 16 of well tube or casing 17. Hollow central shaft 18 is joined to main body 12 by threaded connection 20 and extends downwardly. A second body portion, jet carrier 22 is rotatably mounted on central shaft 18 where it is supported by bearing 26 on flange 24. Seal 28 prevents loss of high pressure fluid into bore 16.

Rotor 30 is also mounted on central shaft 18, so as to be free for rotation and a limited range of axial movement. The upper surface of rotor 30 has striking lugs 34, located to engage reaction lugs 32 on the under surface of jet carrier 22 when rotor 30 is at the contacting end of its range of axial movement. Spacer 36 limits the range of movement in this direction, while snap ring 38 and washer 40 limit movement in the opposite direction, where striking lugs 34 are free to pass reaction lugs 32. The outlet end of central shaft 18 is fitted with flow restricting orifice 42, to provide back pressure for directing fluid flow through connecting ports 44 to axial outlets 46 and tangential outlets 48. Fluid discharged through axial outlets 46 drive rotor 30 to the lug engaging end of its axial movement and fluid flow through tangential outlets 48 generate the rotational energy that causes striking lugs 34 to impact against reaction lugs 32 of jet carrier 22.

Jet head 50 is joined to jet carrier 22 by threaded connection 52, so as to enclose rotor 30 and confine all of the fluid delivered into tool 100 for discharge through multiple small orifices 54 as cleaning jets 56. Preferably, some of jets 56 are directed against the bore wall in a downward direction, so as to undercut the mineral deposits. As rotor 30 is driven to spin, it also moves axially, to engage lugs 32 and 34, and the resulting impact causes incremental rotation of jet carrier 22 and jet head 50. Lugs 32 and 34 have ramp angles so that the impact also causes rotor 30 to be driven to the opposite end of its axial range where the lugs clear and rotor 30 is free to rotate. Thus, cleaning jets 56 can dwell momentarily to more effectively break up mineral deposits 58, while still rotating sufficiently to achieve full bore coverage. The incremental degree of rotation is primarily a function of the amount of back pressure generated by flow restricting orifice 42 and the relative mass of rotor 30 to that of the assembly of jet carrier 22 and jet head 50. Through experimental testing it has been determined that stable jet head rotation rates of 6 r.p.m. or less can be provided by the present invention. Also seen in this view are tangential rotor outlets 48 and axial outlets 46.

Figure 2:
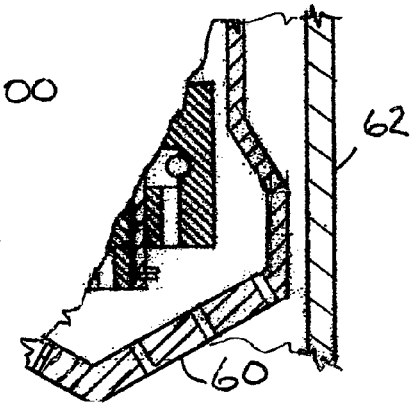
FIG. 2 is a partial view of the FIG. 1 embodiment as adapted to a larger bore size.

FIG. 2 shows an alternative jet head 60 adapted to dean the bore of a larger diameter casing 62. Inasmuch as this is a removable part, tool 100 may be adapted for cleaning a range of different sized well bores.

Figure 3:
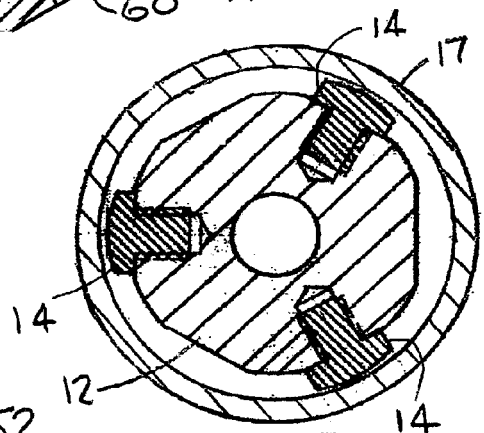
FIG. 3 is a cross-section view of the embodiment of FIG. 1 taken along plane 3-3.

FIG. 3 is a cross-section view of tool 100 showing pads 14, where they are seen to project uniformly from the diameter of tool 100, at equally spaced locations, to hold it centered in the well bore. Again, inasmuch as these are also replaceable parts, different length pads 14 may be installed in main body 12 to centralize tool 100 in different sized well bores. Thus, tool 100 is adaptable to a range of well bore sizes.

Figure 4:
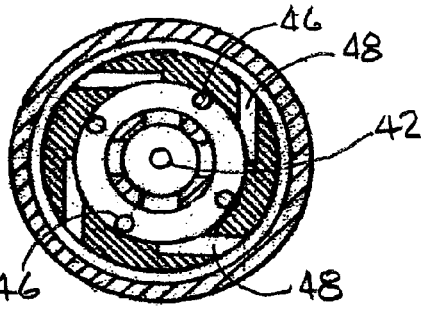
FIG. 4 is a cross-section view taken along plane 4-4 of FIG. 1.

FIG. 4 is a cross-section view of rotor 30 and jet head 50. Here, the arrangement of fluid flow restriction 42 and connecting ports 44 is shown, as is the arrangement of axial outlets 46 and tangential outlets 48. When viewed in conjunction with FIG. 1, it can be seen how fluid flow through axial outlets 46 urges rotor 30 to move for engagement of lugs 32 and 34 and how flow through tangential outlets 48 serves to urge rotation of rotor 30 and impact of striking lugs 34 against reaction lugs 32.

Figure 5:
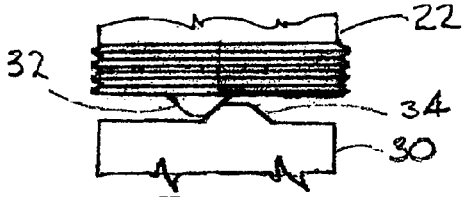
FIG. 5 is a partial side view of the rotor and body of the embodiment of FIG. 1, as seen with the jet head removed.

FIG. 5 is a partial view of rotor 30 and jet carrier 22, showing striking lugs 34 and reaction lugs 32 in contact as they are upon impact. The contacting surfaces are seen to be inclined ramps, directing the impact forces obliquely, so as to not only drive the jet head to rotate slightly, but also to drive rotor 30 to the opposite end of its axial range where the lugs can pass each other.

The embodiments shown and described above are exemplary. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. A rotary jetting tool for connection to a hollow, fluid conducting, workover string comprising;

a main tool body with a hollow central passageway;

a hollow central shaft extending the central passageway from the main tool body;

a rotatable jet carrier mounted on the central shaft;

a rotor, having a first mass and with fluid conducting passageways, mounted on the central shaft for rotation and limited axial movement;

a head, with jet orifices, connected to the jet carrier and housing the rotor, so that the head jet carrier constitute a second mass;

fluid flow reaction outlets in the rotor to urge rotation and axial movement thereof of the rotor with respect to the jet carrier; and a striking lug on the rotor and a cooperating reaction lug on the jet carrier, the lugs located so that relative rotation and axial movement of the rotor establish contact therebetween, and impact of the first mass on the second mass causes resulting in incremental rotation of the jet carrier and head, with the workover string fluid flow being discharged through the jet orifices of the incrementally rotated head.

2. A rotary jetting tool according to claim 1 and further comprising at least three centering pads spaced about the periphery of the tool and extending uniformly so as to loosely fit within a selected tubing diameter.

3. A rotary jetting tool according to claim 1 wherein the jet head is an interchangeable part, selected to fit within a selected tubing diameter.

4. A rotary jetting tool according to claim 1 and further comprising a flow restriction for fluid discharged from the hollow shaft sized to direct an appropriate portion of fluid conducted by the workover string to the rotor reaction outlets.

5. A rotary jetting tool according to claim 1 wherein at least a portion of the jets are directed direct workover string fluid flow downwardly against the bore wall so as to undercut the unwanted deposits.

6. A rotary jetting tool according to claim 1 wherein the rotary speed of incremental rotation does not exceed 60 revolutions per minute.

7. A rotary jetting tool for connection to a hollow, fluid conducting workover string comprising;

a main tool body with an extended hollow central shaft;

a jet carrier mounted to rotate on the central shaft;

a rotor, with fluid conducting passageways and flow reaction outlets, mounted on the central shaft for rotation and axial movement independent of the jet carrier, so that;

engaging surfaces on the jet carrier and rotor intermittently engage for impact to impart rotor energy of rotation to the jet carrier and effect incremental rotation thereof; and a head, with jet orifices, connected to the jet carrier and housing the rotor, so as to confine workover string fluid flow for discharge through the incrementally rotated jet orifices.

8. A rotary jetting tool according to claim 7 and further comprising at least three centering pads spaced about the periphery of the tool and extending uniformly so as to loosely fit within a selected tubing diameter.

9. A rotary jetting tool according to claim 7 wherein the head is an interchangeable part, selected to fit within a selected tubing diameter.

10. A rotary jetting tool according to claim 7 and further comprising a flow restriction for fluid discharged from the hollow shaft sized to direct an appropriate portion of fluid conducted by the workover string to the rotor reaction outlets.

11. A rotary jetting tool according to claim 7 wherein at least a portion of the jets are directed downwardly against the bore wall so as to undercut the unwanted deposits.

12. A rotary jetting tool according to claim 7 wherein the rotary speed of incremental rotation does not exceed 60 revolutions per minute.

13. A method for cleaning unwanted deposits from a well bore with pressurized fluid supplied through a tubing string comprising the steps of:

connecting a rotatable body to the tubing string connecting a multiple orifice, fluid discharging jet head to the rotatable body;

flowing fluid through the tubing string and head;

providing a rotatable mass within the head diverting a portion of the fluid flow to rotate the rotatable mass; and arresting rotation of the rotatable mass periodically power rotation of the rotatable body and head, rotating the body and jet head incrementally, so that the fluid jets impact impinge upon the unwanted deposits during and between increments of rotation; and continuing the incremental jet head rotation and advancing the tubing string so as to remove the unwanted deposits from the well bore.

14. The method of claim 13 and also including the step of centering the rotatable body in the well bore.

15. The method of claim 13 and also including the step of directing a portion of the jets downwardly against the bore wall and undercutting the unwanted deposits.

16. The method of claim 13 including the step of limiting the rotating speed of the jet head to under 60 revolutions per minute.

* * * * *